US005873787A

United States Patent [19]

Colak

[11] Patent Number: 5,873,787

[45] Date of Patent: Feb. 23, 1999

[54] POOL PLAYER STANCE TRAINING MAT

[76] Inventor: John Colak, 14012-120St, Edmonton Alberta, Canada, T4X 4X8

[21] Appl. No.: 901,429

[22] Filed: Jul. 25, 1997

[51] Int. Cl.[6] ..... A63D 15/00

[52] U.S. Cl. ..... 473/2

[58] Field of Search ..... 473/1, 2, 3

[56] References Cited

U.S. PATENT DOCUMENTS

| | | | |
|---|---|---|---|
| 2,708,577 | 5/1955 | Bunka | 473/2 |
| 4,120,494 | 10/1978 | Roe | 473/2 |
| 5,154,415 | 10/1992 | Zotos | 473/2 |
| 5,401,215 | 3/1995 | Pfost | 473/2 |

*Primary Examiner*—Theatrice Brown

*Attorney, Agent, or Firm*—Sixbey, Friedman, Leedom & Ferguson

[57] ABSTRACT

The present invention provides a mat for training proper stance for a pool player. The mat comprises linear indicia marked thereon for alignment with respect to a cue held by the player and hand position indicia marked on the linear indicia for positioning of the mat directly below the player's rear hand when properly held on the cue. Further indicia are marked on the mat for proper location and orientation of the player's right and left feet when the mat has been oriented and positioned with respect to a cue and a cue ball to be hit on the basis of the linear and hand position indicia. When properly used, this mat enables a pool player to quickly and easily understand and adopt a proper stance, resulting in improved consistency of pool playing.

4 Claims, 2 Drawing Sheets

POOL PLAYER STANCE TRAINING MAT

FIELD OF THE INVENTION

The present invention relates to a mat for training proper stance for a pool player.

BACKGROUND OF THE INVENTION

The key to learning to play the game of pool is technique. Technique includes the player's stance, the player's grip on the cue, the player's stroke and the bridge formed by the player's hand. The most important of these is the stance. If a player develops a proper stance then that player is able to learn how to play pool effectively in a fraction of the time it would take otherwise. Once a player is in a proper stance, his or her body must be perfectly still with only the cue arm in motion. This stance is the only one that will give the player the motionless consistency that is required to be a good pool player. Without proper stance, a player will acquire habits that are so bad that it will be difficult for that player to improve no matter how much he or she practices.

Training devices for sports requiring a player to use a bat or club are well-known. Thus, to train a golfer to have a proper stance, and hence golf swing, golf stance alignment mats have been described and illustrated, for example, in Lundquist U.S. Pat. No. 5,611,738 issued Mar. 18, 1997, De Knight et al U.S. Pat. No. 5,478,082 issued Dec. 26, 1995, Todd U.S. Pat. No. 5,590,882 issued Jan. 7, 1997 and Lundquist U.S. Pat. No. 5,492,328 issued Feb. 20, 1996. Batting training devices for baseball, incorporating mats have been taught in Wiseman et al U.S. Pat. No. 5,536,004 issued Jul. 16, 1996 and Pierce U.S. Pat. No. 4,932,656 issued June 12, 1990.

For training of persons to play pool, U.S. Pat. No. 4,120,494 of Roa issued Oct. 17, 1978 describes and illustrates a mat to be placed on a pool table playing surface, on which are marked lines for guiding a player to properly position the cue in making a predetermined billiard shot.

Neither this device, however, nor any of the other devices described above, is of any assistance in teaching proper stance to a pool player.

Thus, it is an object of the present invention to provide a device which will teach a pool player a proper stance for playing pool.

SUMMARY OF THE INVENTION

In accordance with the present invention there is provided a mat for training proper stance for a pool player. The mat comprises linear indicia marked thereon for alignment with respect to a cue held by the player. A hand position indicia is marked on the linear indicia for positioning of the mat directly below the player's rear hand when properly held on the cue. Further indicia are also marked on the mat for proper location and orientation of the player's right and left feet when the mat has been oriented and positioned with respect to a cue and a cue ball to be hit in accordance with the linear and hand position indicia.

In a preferred embodiment of the present invention, the mat bears shoe print indicia for a forward and a rearward foot of the player, with the forward foot being oriented at an angle of about 60° to the other.

Furthermore, it is preferred that the indicia for the forward foot of the player consists of a sequence of shoe prints located, respectively, for a large sized person (over 6'1' in height), a medium sized person (between 5'10" to 6'1½" in height) and a small sized player (under 5'10"), progressively closer to the other of the footprint indicia.

When used, as will be described subsequently herein, the pool player training mat according to the present invention will enable a pool player to quickly and easily understand and adopt a proper stance, resulting in improved consistency of play.

BRIEF DESCRIPTION OF THE DRAWINGS

These and other advantages of the invention will become apparent upon reading the following detailed description and upon referring to the drawings in which.

Figure 1:
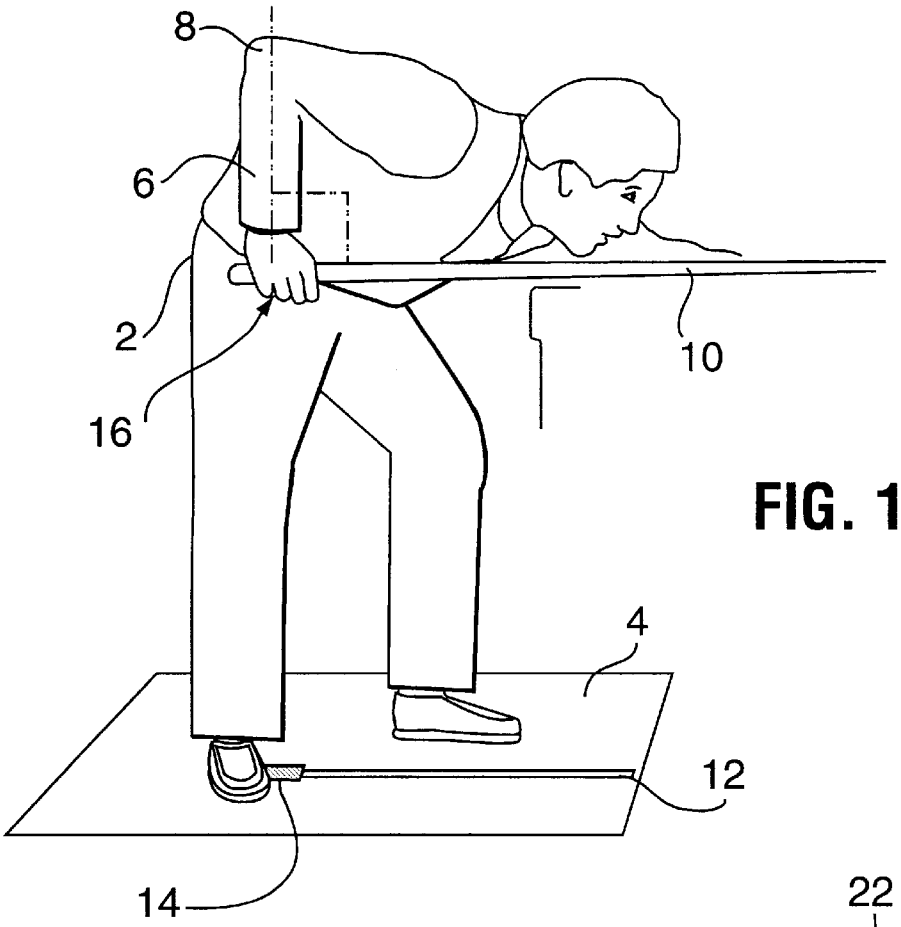
FIG. 1 is a perspective view of a pool player on a training mat according to the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to FIG. 1, there is illustrated a pool player 2 standing on a mat 4 in accordance with the present invention. For proper stance, as illustrated in FIG. 1, one should imagine the forearm 6 of the player's cue arm as a pendulum swinging back and forth from elbow 8. At rest, the cue 10 and forearm 6 should form a right angle.

To assist a player in achieving this stance, mat 4 has been developed. Mat 4 has marked on its surface linear indicia 12, representing a line parallel to the alignment of cue 10 when properly aligned, and hand position indicia 14 properly positioned on linear indicia 12, for positioning of the player's hand vertically above indicia 14 when mat 4 is in use.

Figure 2:
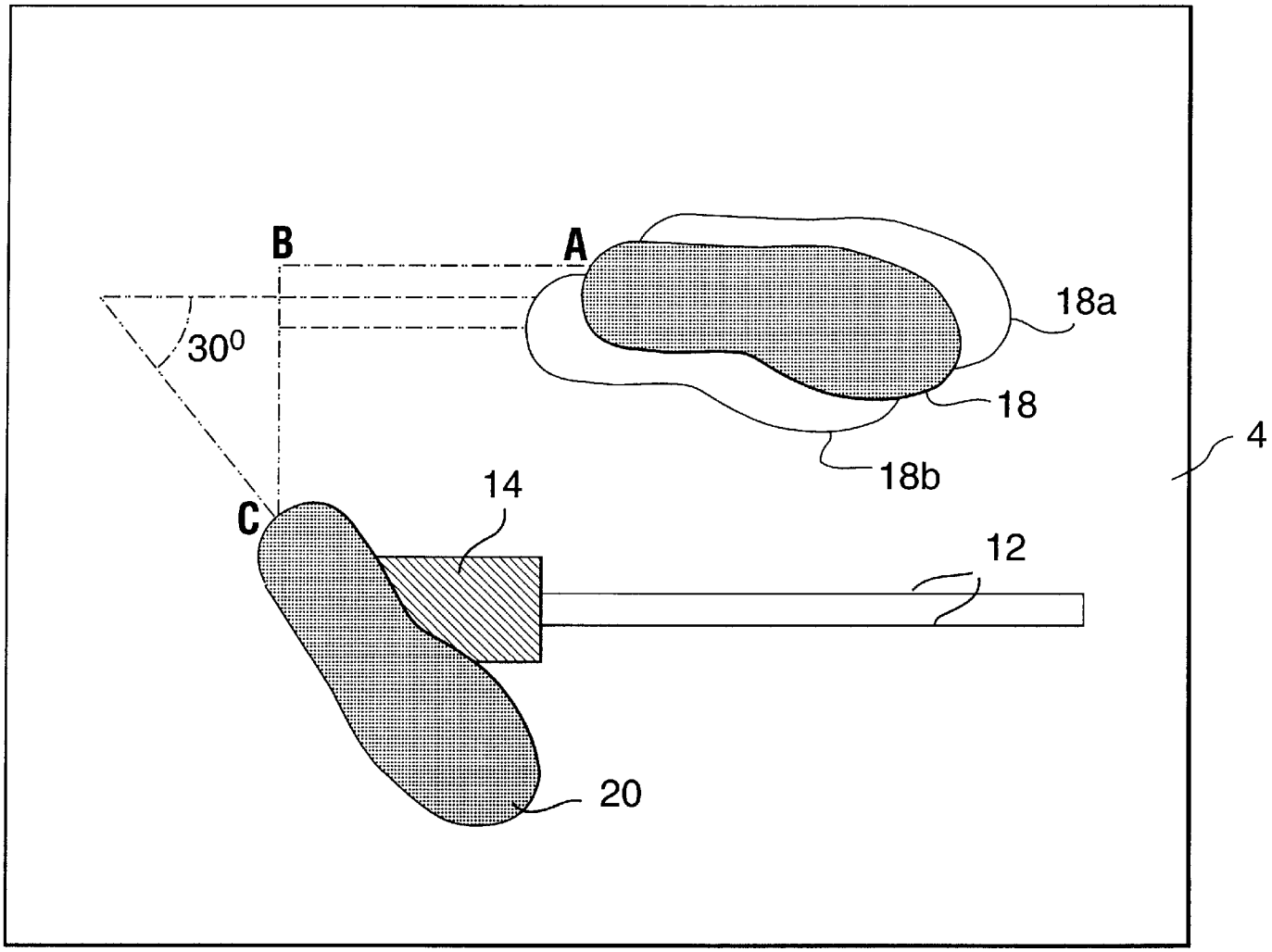
FIG. 2 is a plan view of the training mat of FIG. 1.
Figure 2:
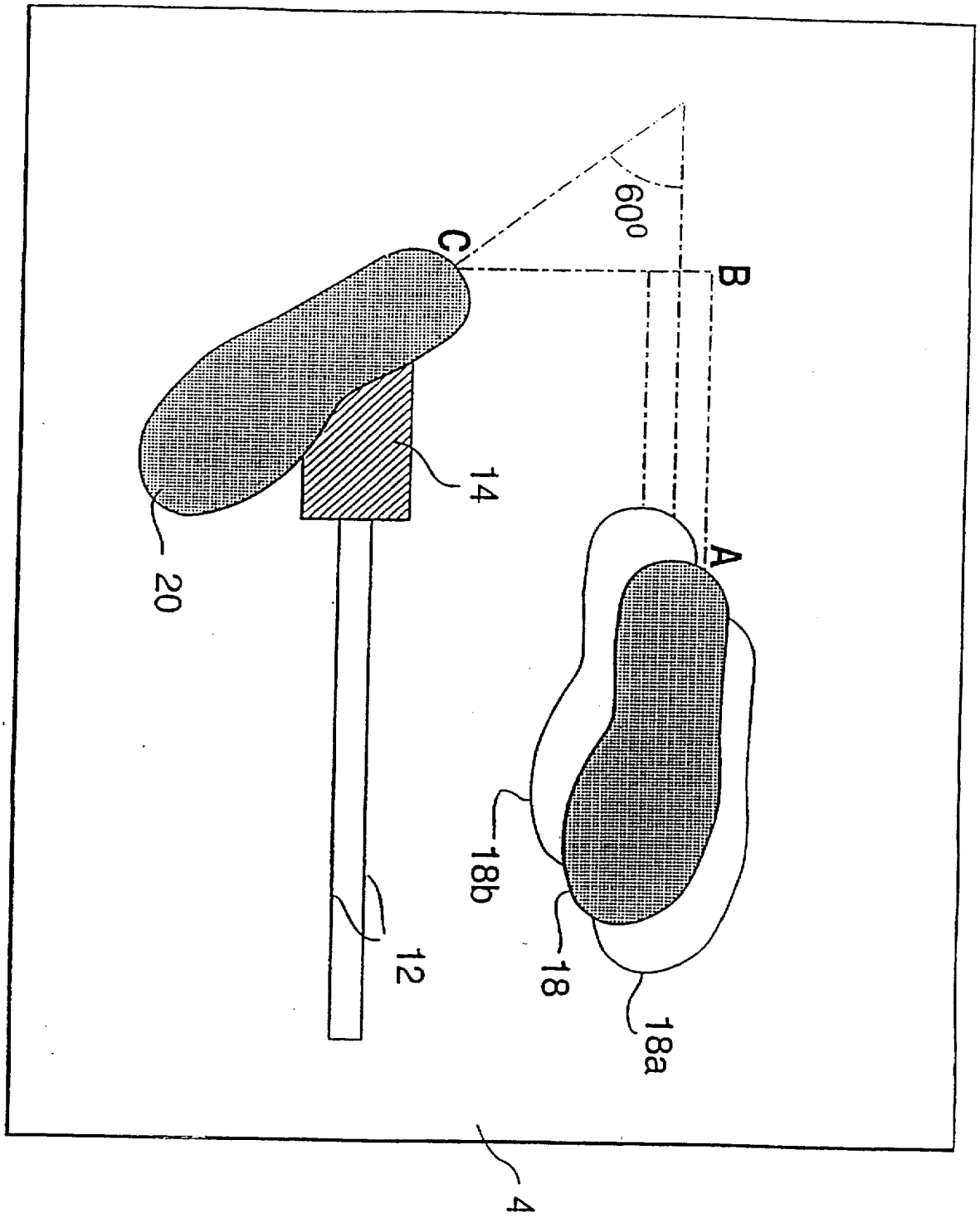

The mat of FIGS. 1 and 2 is designed for a right handed player. The mirror image thereof would be for a left handed player.

On the mat of FIGS. 1 and 2, shoe print indicia 18 (for the forward, left foot) and 20 (for the rearward, right foot) of a player are provided, positioned and located so that when a player stands on the shoe prints, proper stance can be achieved. Shoe prints 18 and 20 are angled at about a 30° angle to each other. The forward, left foot print indicia is in fact a series of such indicia which are progressively closer to shoe print indicia 20, the furthest indicia, 18*a* being intended for the left foot of a large sized person (over 6'1½'), the middle indicia being intended for the left foot of a medium sized person (5'10" to 6'½") and the inner most indicia 18*b* being intended for the left foot of a small sized person (under 5'10"). If a series of right triangles (A,B,C) is imagined with the hypotenuses AC running from the heel portion of each of shoe print indicia 18*a*, 18 and 18*b* to the heel portion of shoe print indicia 20, as illustrated in FIG. 2, ideal dimensions for that triangle, for a small person, would be 8" for distance AB; 6" for BC and 10" for AC, respectively 10", 7" and 12" for a medium sized person and 11½", 8" and 14" for a large person.

Figure 3:
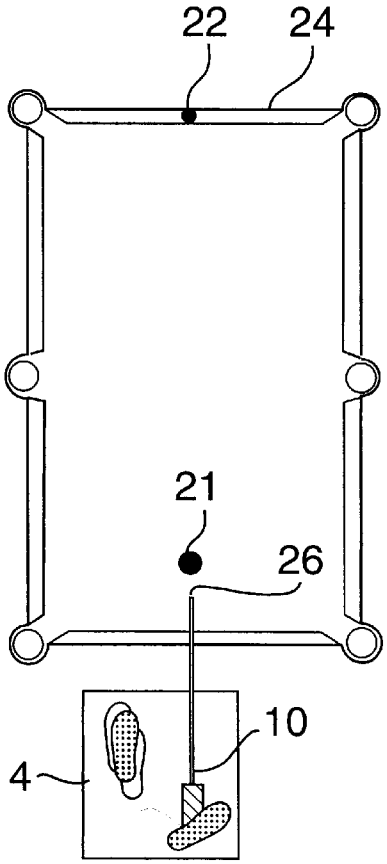
FIG. 3 is a plan view of a pool table marked appropriately for training purposes using the mat in accordance with the present invention.

As a training exercise using the mat 4 in accordance with the present invention, a pool table could be marked as shown in FIG. 3. Spots 21 and 22 are centered from the sides of the table, preferably using a tape measure. Spot 22 should be marked on the top of rail 24 of the table or a piece of cue chalk should be placed on that rail 24 so it is more visible. (Otherwise, it will not be seen by the player once he or she is in a proper stance). The white (cue) ball is placed on spot 21.

To place the mat, the player grips the cue where he or she normally would when he or she is about to shoot, while maintaining this grip the player holds the tip 26 of cue 10 as close to the white ball on spot 21 as possible and in line with spots 21 and 22, the mat is then placed under where the players hand 16 grips the cue 10, vertically above hand indicia 14, and oriented with the cue 10 and linear indicia 12 in parallel alignment. The player then places his or her feet on the appropriate footprints 20 and 18, 18*a* or 18*b*. The right foot is the anchor leg (if the player is right handed) and this leg is locked at the knee. The left leg is bent at the knee. The player's body is bent at the waist to take a shot. The player's bridge hand should be approximately 6" to 8" away from the white ball. The left leg should be bent at the knee just enough so that the cue is parallel to the table and the player's chin as close to the cue as possible so that the player sights the shot as if it was a rifle shot. (Almost all professional snooker players rub their chin on the cue while shooting although being a few inches away is good enough.) This stance locks the player's right shoulder which is very important because when a player is shooting his or her body must be absolutely still with only the forearm in motion.

While maintaining this position, the white ball is shot, in its center from spot 21. The player tries to make the white ball hit in line with spot 22 and come back and roll over spot 21 again. If the player hits it even slightly off center the white ball will not roll over spot 21 after hitting spot 22. By practicing this shot the player eventually develops the proper stance in a manner which will become automatic or second nature to the player.

When a player can do the following shots (all from spot 21 to spot 22) consistently then he or she has developed a proper stance which will give them the consistency and confidence to start playing other shots and not have to worry about whether they have put on any undesired English or spin on the ball (which affects the direction and trajectory of the white ball) and concentrate on developing eyesight and memory for all the different shots there are. The harder one shoots the white ball, the harder it is for it to come back in a straight line but if a player keeps his or her body absolutely still he or she should be able to shoot it hard and make it come back in a straight line.

Thus, it is apparent that there has been provided in accordance with the invention a pool player stance training mat that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A mat for training proper stance for a pool player, the mat comprising linear indicia marked thereon for alignment with respect to a cue held by the player and hand position indicia marked on the linear indicia for positioning of the mat directly below the player's rear hand when properly held on the cue, and further indicia marked on the mat for proper location and orientation of the player's right and left feet when the mat has been oriented and positioned with respect to a cue and a cue ball to be hit in accordance with the linear and hand position indicia.

2. A mat according to claim 1 wherein the mat bears show print indicia for a forward and a rearward foot of the player, the forward foot oriented at an angle of about 60° to the other.

3. A mat according to claim 2 wherein the indicia for the forward foot of the player consists of a sequence of shoe prints located, respectively, for a large sized person (over 6'1" in height), a medium sized person (between 5'10" to 6'1½" in height) and a small sized player (under 5'10"), progressively closer to the other footprint indicia.

4. A mat according to claim 3 wherein the shoe prints are positioned, with respect to an imagined right angled triangle ABC, its hypotenuse AC extending from the heel portion of the shoe print for the forward foot of the player to the heel portion of the other foot would be 10" for a small person, 12" for a medium sized person and 14" for a large person, with the foot print for the front foot being 6" to the side and 8" forward for a small person, 7" to the side and 10" forward for a medium sized person and 8" to the side and 11½" forward for a large sized person.

* * * * *

UNITED STATES PATENT AND TRADEMARK OFFICE

CERTIFICATE OF CORRECTION

PATENT NO. : 5,873,787

DATED : February 23, 1999

INVENTOR(S) : John COLAK

It is certified that error appears in the above-indentified patent and that said Letters Patent is hereby corrected as shown below:

The drawing sheet, consisting of Fig. 2, should be deleted to be replaced with the drawing sheet consisting of Fig. 2, as shown in the attached page.

Signed and Sealed this

Thirtieth Day of November, 1999

*Attest:*

*Attesting Officer*

Q. TODD DICKINSON

*Acting Commissioner of Patents and Trademarks*